US005850868A

United States Patent [19]

Okada et al.

[11] Patent Number: 5,850,868

[45] Date of Patent: Dec. 22, 1998

[54] CASTING METHOD WITH IMPROVED RESIN CORE REMOVAL STEP

[75] Inventors: Yuji Okada; Masamichi Okada, both of Toyota; Tsutomu Ishikawa; Takumi Yamamoto, both of Kariya; Tatsuhiko Sawamura, Tokyo-to; Norio Hayashi, Yokkaichi; Takayuki Ito, Hiratsuka, all of Japan

[73] Assignees: Toyota Jidosha Kabushiki Kaisha, Toyota; Aisin Seiki Kabushiki Kaisha, Kariya; Toshiba Silicon Kabushiki Kaisha, Tokyo, all of Japan

[21] Appl. No.: 609,673

[22] Filed: Mar. 1, 1996

[30] Foreign Application Priority Data

Mar. 3, 1995 [JP] Japan ..... 7-044109

[51] Int. Cl.[6] ..... B22D 29/00; B22C 9/10

[52] U.S. Cl. ..... 164/132; 164/369

[58] Field of Search ..... 164/132, 369, 164/520, 529, 131, 138, 365, 30

[56] References Cited

U.S. PATENT DOCUMENTS

| | | | |
|---|---|---|---|
| 3,825,055 | 7/1974 | Mino et al. | 164/132 |

FOREIGN PATENT DOCUMENTS

| | | |
|---|---|---|
| 0 677 346 | 10/1995 | European Pat. Off. . |
| 0 685 278 | 12/1995 | European Pat. Off. . |
| 30 30 497 | 3/1981 | Germany . |
| 56-95447 | 8/1981 | Japan . |
| 61-293646 | 12/1986 | Japan . |
| 3-66445 | 3/1991 | Japan . |
| 4-189523 | 7/1992 | Japan . |
| 6-91345 | 4/1994 | Japan . |
| 6-91656 | 4/1994 | Japan . |
| 6-99247 | 4/1994 | Japan . |
| 6-99436 | 4/1994 | Japan . |
| 6-122037 | 5/1994 | Japan . |
| 6-126376 | 5/1994 | Japan . |
| 6-198388 | 7/1994 | Japan . |
| 6-292941 | 10/1994 | Japan . |
| 6-328195 | 11/1994 | Japan . |
| 294791 | 2/1954 | Switzerland . |
| 2 269 771 | 2/1994 | United Kingdom . |
| 2 269 771A | 2/1994 | United Kingdom . |

*Primary Examiner*—Patrick Ryan
*Assistant Examiner*—I.-H. Lin
*Attorney, Agent, or Firm*—Oblon, Spivak, McClelland, Maier & Neustadt, P.C.

[57] ABSTRACT

A casting method is disclosed in which a resin core is fabricated by using a resin which maintains a mechanical strength satisfying a shape accuracy required for a cast product until solidification of molten metal in contact with the core and is softened when heated beyond the core temperature at which the molten metal in contact with the core was solidified. The removal of the resin core from the cast product after the cast product containing the core from a die, includes a step of forcedly cooling the cast product containing the core down to a predetermined temperature at which the resin core can be removed from the cast product without being broken apart by pulling one of its ends, and a step of withdrawing the core at the predetermined temperature from the cast product having been forcedly cooled down. It is thus possible to cool the core down to a predetermined temperature suited for the withdrawal and preclude the inconvenience that the core being pulled is broken apart.

4 Claims, 2 Drawing Sheets

CASTING METHOD WITH IMPROVED RESIN CORE REMOVAL STEP

BACKGROUND OF THE INVENTION

1. Field of the Invention

This invention relates to techniques of removing a core used for casting from a cast product. According to the invention, a resin core is used. The resin used for the core is of such a character as to maintain a mechanical strength satisfying a shape accuracy required for the cast product until solidification of molten metal in contact with the core and be softened when heated beyond the core temperature at which the molten metal in contact with the core was solidified.

2. Description of the Prior Art

A core is used to form a cavity, a hole, etc. in a cast product. In case of a cast product having a cavity of an undercut shape, the core should be such that it can be crumbled and taken out of the cast product after the casting. When producing-an undercut shape, a sand core consisting of a mass of sand is usually used.

A sand core has excellent heat resistance. However, the process of its fabrication is complicated. Accordingly, a technique of fabricating resin cores has been developed. The technique is disclosed in Japanese Laid-Open Patent Publication No. 6-99247. Prior to the development of this technique, it was thought that a cavity having a desired shape can not be formed with a resin core because the resin is softened during casting. However, it was confirmed that even a resin core can maintain a sufficient mechanical strength until molten metal in contact with the core is solidified so that it is possible to form a cavity having an intended shape in the cast product.

When using a resin core, the temperature of the resin is increased continually after establishment of the shape of the cast product and eventually, the resin core turns to be fused. The fused core can be removed from the cast product.

With a core having a complicated shape, however, it is difficult to completely remove the fused resin from the cast product, and the fused resin partly remains in the cast product.

3. Description of Related Application

One of the joint applicants of the present application developed a technique of removing a resin core from the cast product. The technique is applied as Japanese Patent Application No. 6-120279. The application is not laid open when this application is filed. The technique is one in which a resin core is used in a die casting process. Suitable resins used as the core material are polycarbonate, polypropyrene and like resins which have high glass transition point as well as being high in both impact strength and ductility. FIG. 3 shows a manner of temperature change of a portion of molten metal (for instance, molten aluminum alloy) in contact with the resin core during casting (solid curve A) and also a manner of average temperature change of a core made of polycarbonate or like resin (broken line curve G1). In the graph, the ordinate is taken for the temperature, and the abscissa is taken for the time. Point t0 in the time axis represents an instant of start of charging of molten metal into the cavity of a die (not shown), and point ta represents an instant of completion of the charging of molten metal. The molten metal charged into the cavity is reduced in temperature with the cooling of the die and the core, and its solidification is started from its portions in contact with the die and the core. When the molten metal has been entirely solidified, the die is opened. Point T1 in the time axis represents an instant when molten metal in contact with the core is solidified.

The core is raised in temperature as it receives heat from the molten metal. The core material, such as polycarbonate or polypropyrene, has low heat conductivity, and the inside of the core is held at relatively low temperatures even when the temperature of the core surface in contact with molten metal becomes substantially equal to the temperature of molten metal.

The exemplified resin is at temperatures in a high rigidity temperature range while the core temperature is increased from normal temperature to 160° C. In this range, the resin maintains high mechanical strength without being substantially softened. Thus, even with the application of high pressure by molten metal to the core, the deformation thereof is held within a range in which the shape accuracy required for the cast product is satisfied, and a function required for the die casting core can be obtained. When the core is at temperatures ranging from 160° C. to about 200° C., it is in a medium rigidity temperature range. In this temperature range, the core has an inner portion having relatively high mechanical strength, although its surface is softened. Thus, the core is not broken apart by pulling it although it may be deformed by so doing. Before the medium rigidity temperature range of the core is brought about, the molten metal in contact with the core has already been solidified. In this state, the softening of the core surface has no adverse effect on the shape of the cast product. When the core is at temperatures exceeding 200° C., it is in a low rigidity temperature range. In this temperature range, the core is softened in its inner portion as well. In this high temperature range, the core is readily broken apart by pulling it. The resin, on the other hand, is readily flowable. In the technique disclosed in Japanese Laid-Open Patent Publication No. 6-99247 noted above, the core is removed by making use of the fluidity of the resin. The above-mentioned application (Japanese Patent Application No. 6-120279) discloses a technique in which the die is opened while the core is in the medium rigidity temperature range, and one end of the core is pulled from the outside of the cast product, so that the core is removed from the cast product without being broken apart.

SUMMARY OF THE INVENTION

The temperature change characteristic of the core, i.e., the temperature rise slope (temperature rise rate), varies slightly in dependence on the ratio between the volume of the cast product and the volume of the core, the shape thereof, etc. For example, in such case as when the volume of the core Is small compared to the volume of the cast product or when the thickness of the core is small, the temperature rise rate of the core is high (see dashed curve G2 in FIG. 3). In such a case, at the time of the removal of the resin core, the core temperature is unexpectedly increased so that the core may be broken apart as it is withdrawn from the cast product. A core part that remains in the cast product has to be taken out after softening it by re-heating the cast product. Doing so may result in the spoiling of the appearance of the cast product due to thermal strain or like cause as well as increasing energy expenditure.

An object of the invention is to forcedly cool the cast product having been taken out from the die to lower the core temperature to a temperature range suited for the withdrawal of the core so that the core can be withdrawn smoothly from the die at that temperature.

According to one aspect of the invention, there is provided a casting method in which a core is fabricated by using a resin which maintains a mechanical strength satisfying a shape accuracy required for a cast product until solidification of molten metal in contact with the core and is softened when heated beyond the core temperature at which the molten metal in contact with the core was solidified, and in which the resin core is removed from the cast product after the casting. After the cast product containing the core has been take out from the die, a step is executed in which the cast product is forcedly cooled down to a predetermined temperature at which the resin core can be removed from the cast product without being broken apart by pulling one of its ends.

According to this aspect, even when the core temperature is above a predicted temperature at the time of opening the die, it is possible, through forced cooling of the cast product taken out of the die, to cool the core down to a predetermined temperature suited to the withdrawal. The core is withdrawn from the cast product when the core is cooled down to the predetermined temperature. Thus, the inconvenience that the core is broken apart as it is pulled can be eliminated, thus precluding such cumbersomeness as taking out a core part that is left without being withdrawn.

The forced cooling of the cast product containing the core is suitably done by dipping the cast product in a liquid coolant held at the predetermined temperature. This method permits ready cooling of the core to a predetermined temperature irrespective of the size and temperature of the cast product and the core. The core thus can be readily cooled down to a predetermined temperature even when the cast product or the core has a three-dimensionally buckled shape or a shape having an undercut and also irrespective of the size of the cast product and the core. Stable withdrawal of the core thus can be ensured.

According to another aspect of the invention, there is provided a casting method in which a core is fabricated by using a resin which maintains a mechanical strength satisfying a shape accuracy required for a cast product until solidification of molten metal in contact with the core and is softened when heated beyond the core temperature at which the molten metal in contact with the core was solidified, and in which the resin core is removed from the cast product after the casting. After the cast product containing the core has been taken out from the die, a step of tentatively cooling the cast product containing the core down to the neighborhood of normal temperature, and a step of re-heating the tentatively cooled cast product up to a predetermined temperature at which the resin core can be removed from the cast product without being broken apart by pulling one of its ends, are executed.

According to this aspect, the core temperature is raised to a predetermined temperature by re-heating the cast product containing the core. Ready core temperature control is thus obtainable irrespective of the size of the cast product or the core, thus ensuring stable withdrawal of the core.

BRIEF DESCRIPTION OF THE DRAWINGS

The invention will be more fully understood from the detailed description of the preferred embodiments and claims when the same is read with reference to the accompanying drawings, in which:

DETAILED DESCRIPTION OF THE PREFERRED EMBODIMENTS

First Embodiment

A method of resin core removal according to a first embodiment of the invention will now be described with reference to FIGS. 1 and 2(A).

This embodiment shows a method of withdrawing a resin core from a cast product obtained by high pressure casting carried out by setting the resin core in a die of a die casting machine (not shown). The resin which is used suitably as the core material, may be polycarbonate, polypropyrene, polystyrene, etc. Molten metal which is charged under pressure into the die is molten aluminum alloy.

Figure 3:
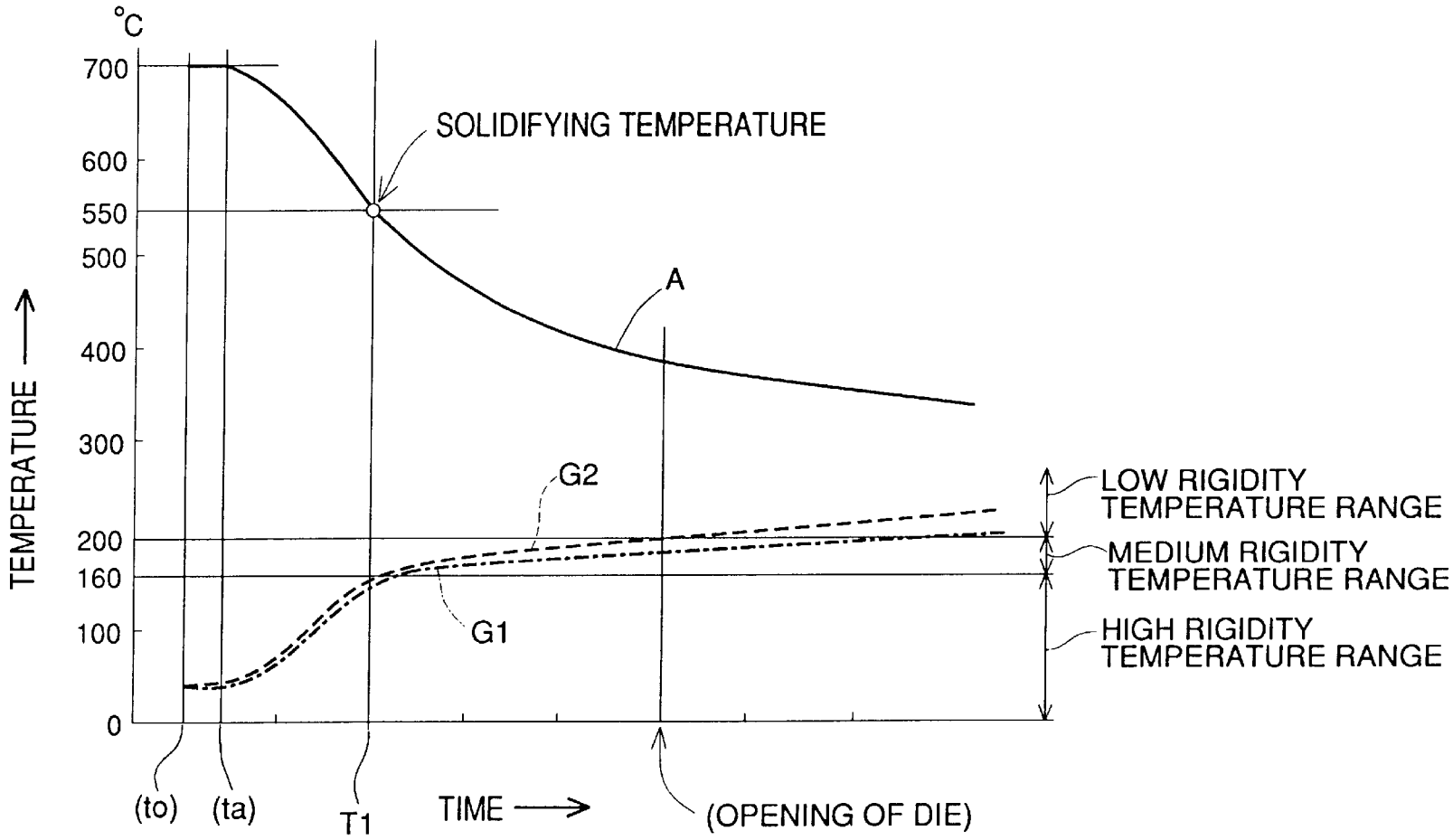
FIG.3 RELATED ART
FIG. 3 is a graph for describing the prior art core removal method.

The resin noted above has a high softening temperature as well as being high in both impact strength and ductility. Thus, the core which is fabricated from this resin is not deformed beyond the shape accuracy required for the cast product even when it is in contact with high pressure, high temperature molten metal. In addition, the core can hold sufficient mechanical strength for being free from deformation beyond the shape accuracy noted above until solidification of molten metal in contact therewith to a predetermined thickness. The shape of the cast product is established while the resin is in the high rigidity state as shown in FIG. 3, and subsequent softening of the resin does not spoil the shape accuracy of the cast product.

In this embodiment, the core is fabricated by injection molding of the resin as noted above, and is set in the die. Then, molten metal is charged under high pressure into the cavity. As shown by pattern I (solid line) in FIG. 1 and FIG. 2(A), when the die is opened after casting, the cast product containing the core is separated from the die and dipped in a normal temperature water bath (not shown) for forced direct cooling. The cast product and the core are thus quickly cooled down to the neighborhood of normal temperature.

After the cast product and the core have been cooled down to the neighborhood of normal temperature, they are heated again in a heat treatment furnace or a high frequency heating furnace (not shown) up to a predetermined temperature suited for the withdrawal of the core. The predetermined temperature noted above is such that at this temperature the core can be pulled at one of its ends without being broken apart. It is 180° C. to 220° C. in case of polycarbonate and 100° C. to 150° C. in case of polypropyrene and polystyrene.

The cast product and the core which have been heated to the predetermined temperature noted above, are held at that temperature for a predetermined period of time, and then the core is withdrawn from the cast product. At this time, the core is in the medium rigidity temperature range as shown in FIG. 3, and can be removed from the cast product without being broken apart by pulling one of its ends.

As shown, in this embodiment, the cast product separated from the die is tentatively cooled down by dipping it in a water bath. The core thus can be quickly cooled down to the neighborhood of normal temperature even when the core temperature has been raised beyond the predicted level at the time of opening of the die. In addition, since the cooling is done by dipping the cast product and the core in a water bath, cooling down to the neighborhood of normal temperature can be obtained without fluctuations irrespective of the size and temperature of the cast product and the core. Moreover, since the cast product containing the core is heated to raise the core temperature up to the predetermined temperature, ready core temperature control is obtainable irrespective of the size of the cast product and the core. Since the core held at the predetermined temperature is withdrawn from the cast product, no such inconvenience as breakage of the core during pulling thereof takes place. Cumbersomeness of an otherwise required after-process of taking out a core part remaining without being withdrawn is thus unnecessary.

Second Embodiment

A resin core removal method according to a second embodiment of the invention will now be described with reference to FIGS. 1 and 2(B).

The resin core removal method in this embodiment is a modification of the forced cooling in the preceding first embodiment.

Figure 1:
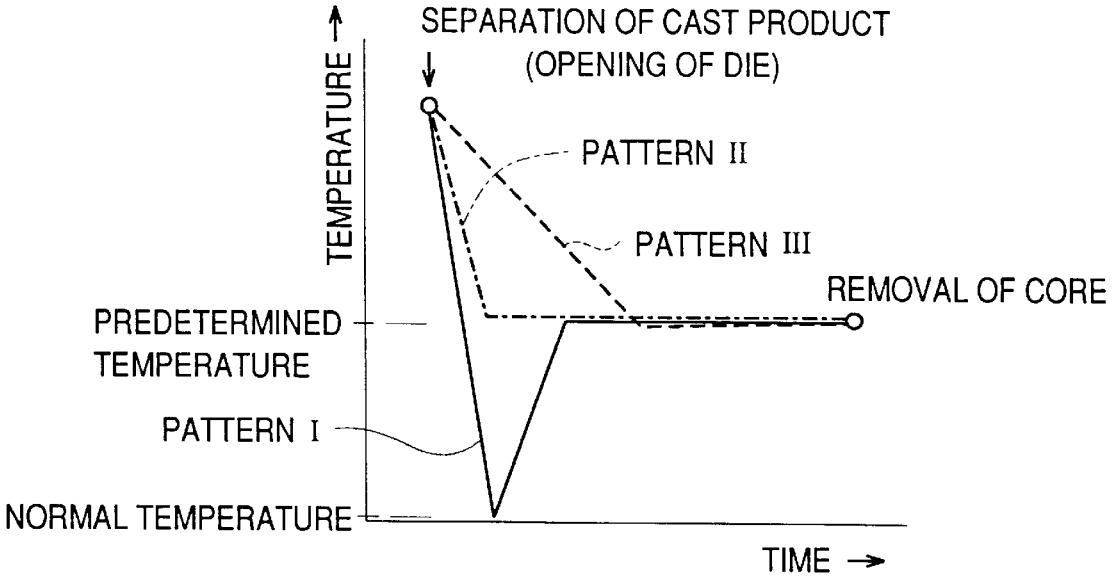
FIG. 1 is a graph showing a pattern of forced cooling of a cast product and a core used in a core removal step according to the invention.
Figure 2A:
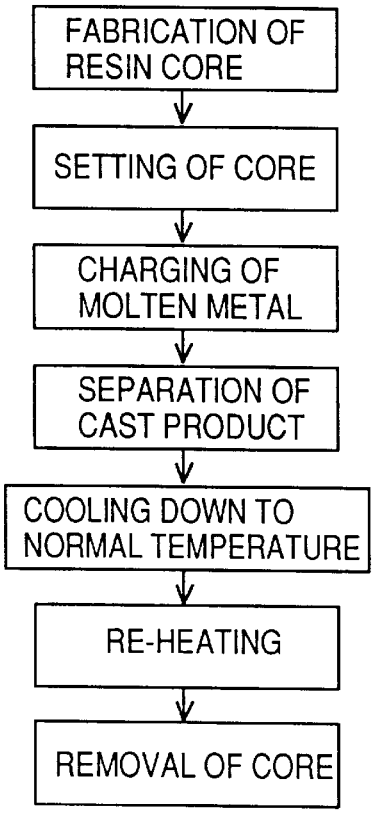
FIGS. 2(A) and 2(B) are flow charts showing individual steps in the casting method according to the invention.
Figure 2B:
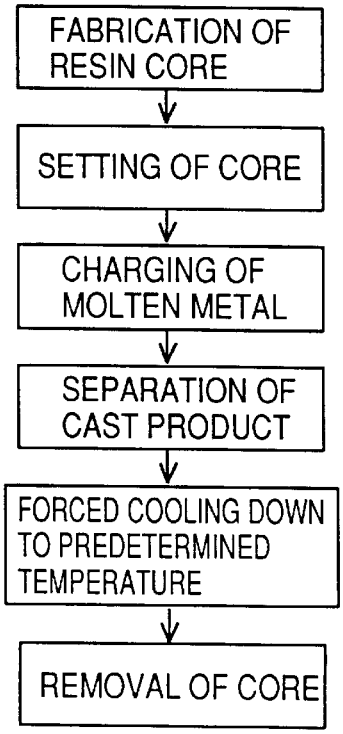

In this embodiment, as shown by pattern II (broken line) in FIG. 1 and FIG. 2(B), when the die is opened after casting, the cast product containing the core is separated from the die and dipped in an oil bath or a salt bath (not shown) held at a predetermined temperature. The predetermined temperature is one at which the resin is in the medium rigidity temperature range. The dipping has an effect of forcedly cooling the cast product and the core down to a predetermined temperature. The predetermined temperature is, like the case of the first embodiment, 180° C. to 220° C. in case of polycarbonate and 100° C. to 150° C. in case of polypropyrene and polystyrene.

As shown, in this embodiment, the cast product and the core are cooled by dipping in an oil bath or the like, and cooling down to the predetermined temperature can be obtained without fluctuations irrespective of the size and temperature of the cast product and the core. Unlike the first embodiment, the heat treatment furnace or high frequency heating furnace is unnecessary. However, equipment for holding the oil bath or the salt bath at a predetermined temperature is necessary. In addition, a step of washing off oil or salt from the cast product after removal of the core is necessary.

Third Embodiment

A resin core removal method according to a third embodiment of the invention will now be described with reference to FIGS. 1 and 2(B). Again, the resin core removal method in this embodiment is a modification of the forced cooling method in the first embodiment.

In this embodiment, as shown by pattern III (dashed line) in FIG. 1 and FIG. 2(B), when the die is opened after casting, the cast product containing the core is separated from the die and is forcedly cooled down to a predetermined temperature using air or steam. The predetermined temperature is, like the case of the first embodiment, 180° C. to 220° C. in case of polycarbonate and 100° C. to 150° C. in case of polypropyrene and polystyrene.

This embodiment has a merit that the installation cost can be reduced because no water bath or oil bath is necessary.

While some preferred embodiments of the invention have been described, it is to be understood that these embodiments are by no means limitative, and changes and modifications may be made in the details of design without departing from the scope and spirit of the invention.

What is claimed is:

1. A casting method comprising the steps of:

fabricating a resin core;

setting the resin core in a die;

subsequently charging molten metal into the die to form a cast product;

subsequently taking out the cast product from the die by opening the die; and subsequently removing the resin core from the cast product;

the resin of the core being of such a character as to maintain a mechanical strength satisfying a shape accuracy required for the cast product until solidification of molten metal in contact with the core and be softened when heated beyond the core temperature at which the molten metal in contact with the core was solidified; and forcibly directly cooling the cast product containing the core down to a predetermined temperature at which the resin core can be removed from the cast product without being broken apart by pulling one of its ends, the forced cooling being executed after taking out the cast product from the die and before removing the resin core from the cast product.

2. The casting method according to claim 1, wherein the cast product containing the core is forcibly cooled down by dipping the cast product in a liquid coolant held at a predetermined temperature.

3. A casting method comprising the steps of:

fabricating a resin core;

setting the resin core in a die;

subsequently charging molten metal into the die to form a cast product;

subsequently taking out the cast product from the die by opening the die; and subsequently removing the resin core from the cast product, the resin of the core being of such a character as to maintain a mechanical strength satisfying a shape accuracy required for the cast product until solidification of molten metal in contact with the core and be softened when heated beyond the core temperature at which the molten metal in contact with the core was solidified;

tentatively directly cooling the cast product containing the core down to near an ambient temperature; and re-heating the tentatively cooled cast product up to a predetermined temperature at which the resin core can be removed from the cast product without being broken apart by pulling one of its ends, the tentative cooling and the re-heating being executed after taking out the cast product from the die and before removing the resin core from the cast product.

4. The casting method according to claim 1, wherein the cast product containing the core is tentatively cooled down by dipping the cast product in a liquid coolant held at the ambient temperature.

* * * * *